US005299892A

United States Patent [19]

Pickert

[11] Patent Number: 5,299,892

[45] Date of Patent: Apr. 5, 1994

[54] BORONNITRIDE COATED MICROCUTTING DEVICE

[75] Inventor: Werner Pickert, Coburg, Fed. Rep. of Germany

[73] Assignee: Kapp & Co. Werkzeugmaschinenfabrik, Coburg, Fed. Rep. of Germany

[21] Appl. No.: 900,016

[22] Filed: Jun. 17, 1992

[30] Foreign Application Priority Data

Jun. 17, 1991 [DE] Fed. Rep. of Germany ..... 4119872

[51] Int. Cl.[5] ..... B26D 1/12

[52] U.S. Cl. ..... 407/32; 407/54; 407/64; 407/119

[58] Field of Search ..... 407/32, 54, 64, 118, 407/119

[56] References Cited

U.S. PATENT DOCUMENTS

| | | | |
|---|---|---|---|
| 2,318,549 | 5/1943 | Wilkie | 407/118 |
| 3,531,840 | 10/1970 | Tupper . | |
| 3,553,905 | 1/1971 | Lemelson | 407/118 X |

FOREIGN PATENT DOCUMENTS

| | | | |
|---|---|---|---|
| 7601299 | 1/1976 | Fed. Rep. of Germany . | |
| 3912681 | 4/1989 | Fed. Rep. of Germany . | |
| 1206286 | 2/1960 | France | 407/118 |
| 55-119176 | 9/1980 | Japan . | |
| 63-068314 | 3/1988 | Japan . | |

*Primary Examiner*—Timothy V. Eley

*Attorney, Agent, or Firm*—Robert W. Becker & Associates

[57] ABSTRACT

A rotating tool for the cutting of hardened workpieces is comprised of a base body made of steel and having a working surface. The working surface is coated with a homogeneous layer of an extremely hard material. The layer has a uniform thickness. The working surface has a plurality of microcutting grooves that extend parallel to one another and at an acute angle relative to a tangent of the working surface. Each microcutting groove has a cross-sectional profile with a cutting edge and a chip space. The extremely hard material is preferably boron nitride and the base body is preferably made of hardened steel.

10 Claims, 2 Drawing Sheets

BORONNITRIDE COATED MICROCUTTING DEVICE

BACKGROUND OF THE INVENTION

The present invention relates to a rotating tool for the cutting of hardened workpieces that are preferably made of steel. The tool is comprised of a base body with a defined working surface and is preferably made of steel, preferably hardened steel, whereby the working surface is provided with a coating of an extremely hard material, preferably boron nitride.

Such rotating tools, preferably in the form of grinding disks, are known. They have the disadvantage that no defined cutting edge is provided. Instead, the individual particles of the extremely hard material forming the coating provide a plurality of randomly positioned cutting surfaces. This results in a wide range of the respective service life of these rotating tools.

It is therefore an object of the present invention to provide a rotating tool of the aforementioned kind which is provided with a defined cutting edge and which is suitable for the precision machining of workpieces made of a material having a Rockwell hardness of up to 62 HRC.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The rotating tool for the cutting of hardened workpieces according to the present invention is primarily characterized by a base body made of steel having a working surface, the working surface being coated with a homogeneous layer of a uniform thickness of an extremely hard material and having a plurality of microcutting grooves that extend parallel to one another and at an acute angle relative to a tangent of the working surface, each microcutting groove having a cross-sectional profile with a cutting edge and a chip space. Preferably, the extremely hard material is boron nitride. It is furthermore advantageous that the base body be made of hardened steel.

The advantage of the inventive design lies in the fact that a defined cutting edge is provided so that with the inventive tools a predetermined service life may be achieved. With the inventive tools a constant and higher number of finished workpieces may be accomplished.

In a preferred embodiment the cross-sectional profile of the microcutting groove has a sawtooth shape with an essentially radially extending breast portion with a radially outwardly oriented end forming the cutting edge, a sawtooth head extending essentially in a circumferential direction, and a sawtooth back portion forming the chip space.

It is preferred that the distance between adjacent ones of the microcutting grooves is 35 to 600 μm and the depth of the microcutting grooves is 20 to 1,000 μm. The thickness of the layer of extremely hard material is preferably 1 to 5 μm.

In a preferred embodiment, the working surface further comprises transverse grooves that divide the microcutting grooves, the transverse grooves extending at an angle relative to the microcutting grooves. Preferably, the microcutting grooves and the transverse grooves extend in an arcuate manner. It is also possible that only the transverse grooves or the microcutting grooves extend in an arcuate manner.

Providing the working surface with the transverse grooves in addition to the microcutting grooves has the advantage that the cutting edges are divided resulting in smaller cutting chips and a better access of cooling and lubricating medium to the cutting edges.

Advantageously, the base body is shaped according to a desired contour of the workpieces to be finished.

With the present invention it is suggested to adapt the form of the tool to the desired contour of the workpiece to be finished, for example, to the form of a toothing or other profile, so that with the inventive tool toothings and other complicated profiles may be manufactured.

DESCRIPTION OF PREFERRED EMBODIMENTS

The present invention will now be described in detail with the aid of several specific embodiments utilizing FIGS. 1 through 4.

Figure 1:
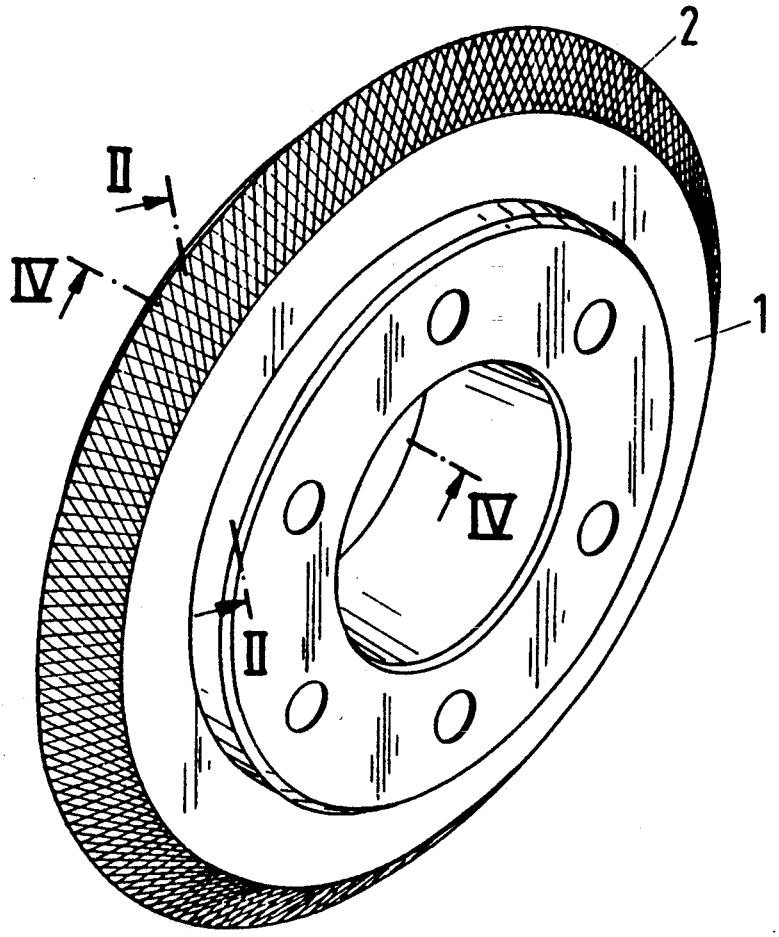
FIG. 1 is a perspective view of a grinding disk.
Figure 2:
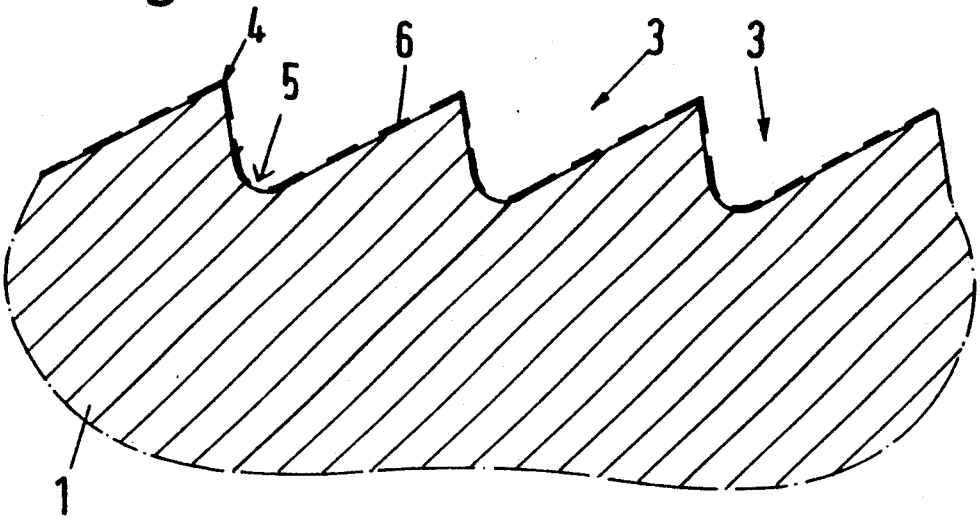
FIG. 2 is a part cross-sectional of the working surface of the grinding disk along the line II—II of FIG. 1.
Figure 3:
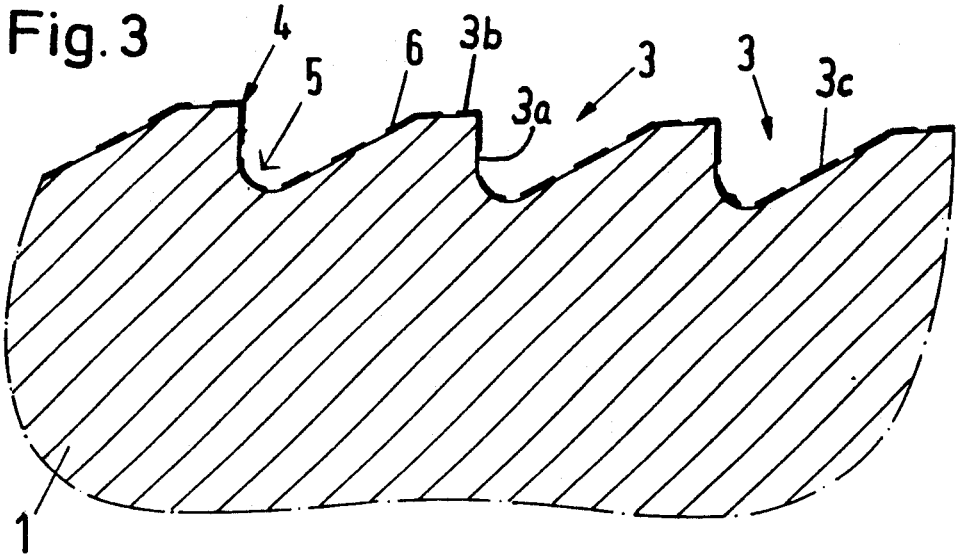
FIG. 3 is a part cross-sectional view corresponding to the view of FIG. 2 for a further embodiment of the invention.
Figure 4:
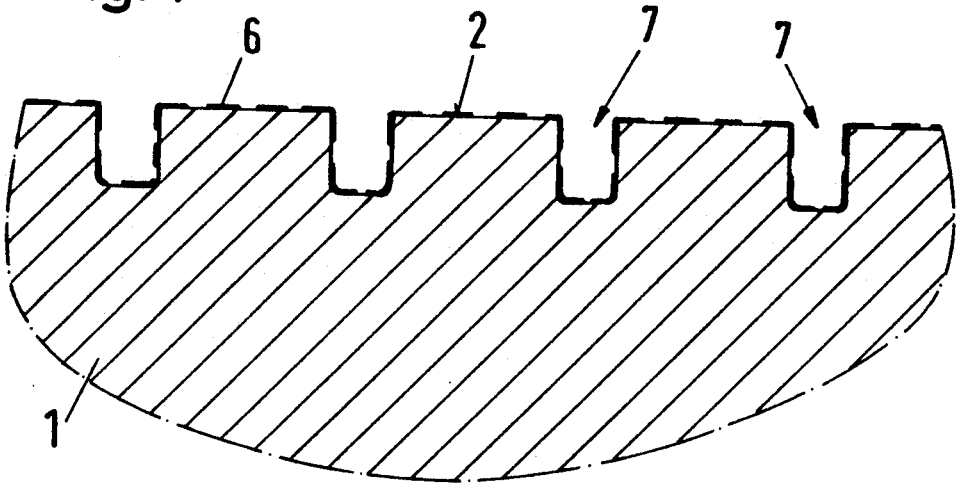
FIG. 4 is a further part cross-sectional view along the line IV—IV of FIG. 1.

The grinding disk shown in a perspective representation in FIG. 1 is comprised of a steel base body 1 which is provided with a defined working surface 2. This working surface 2 has a plurality of microcutting grooves 3 that extend parallel to one another and whose cross-sectional contour is represented in FIGS. 2 and 3. These microcutting grooves 3 extend at an acute angle to a tangent of the working surface 2. The cross-sectional profile provides a defined cutting edge 4 and a defined chip space 5. The entire working surface 2 of the base body 1 is provided with a homogeneous layer 6 of an extremely hard material, the layer having a uniform thickness. As a suitable hard material boron nitride is preferably used.

In contrast to the known boron nitride coated grinding disks, the inventive embodiment of the rotating tool for cutting workpieces provides a plurality of defined cutting edges due to the profiling of the working surface 2 with the aforementioned microcutting grooves 3. The service life of the tool is accordingly better predictable so that constant and higher numbers of finished workpieces may be accomplished.

The cross-sectional profile of the microcutting grooves 3 may be embodied according to FIG. 2 with teeth of an acute angle or according to FIG. 3 with a sawtooth shape. The sawtooth shape has a radially extending "breast" portion 3*a* having at the radially outwardly oriented end the cutting edge 4, and further has a tooth head 3*b* which essentially extends in the circumferential direction, and a chip space 5 formed by the tooth back portion 3*c*. In either embodiment, the distance between the microcutting grooves 3 is between 35 to 600 μm, and the depth of the grooves 3 is between 20 to 1,000 μm. The layer 6 of an extremely hard material which is provided over the entire surface area of the working surface 2 has a thickness of 1 to 5 μm.

In the embodiment represented in FIG. 1 the grinding disk is provided with transverse grooves 7 in addition to the microcutting grooves 3, whereby the transverse grooves 7 extend at an angle relative to the microcutting grooves 3. A preferred cross-section of these transverse grooves 7 is shown in the sectional representation of FIG. 4.

While in the represented embodiment the microcutting grooves 3 as well as the transverse grooves 7 extend in a straight line, it is also possible to provide the microcutting grooves 3 and/or the transverse grooves 7 in an arcuate manner. In the case that with the inventive tool a precision machining of a hardened material by a profile grinding step is desired, the contour of the working surface 2 may be adapted to the desired contour of the workpieces to be finished.

The present invention is, of course, in no way restricted to the specific disclosure of the specification and drawings, but also encompasses any modifications within the scope of the appended claims.

What I claim is:

1. A rotating tool for the cutting of hardened workpieces, comprising:

a base body made of steel having a working surface, said working surface being coated with a homogeneous layer of a uniform thickness of an extremely hard material and having a plurality of micro cutting grooves that extend parallel to one another and at an acute angle relative to a tangent of said working surface, each said micro cutting groove having a cross-sectional profile with a cutting edge and a chip space.

2. A rotating tool according to claim 1, wherein said extremely hard material is boron nitride.

3. A rotating tool according to claim 1, wherein said base body is made of hardened steel.

4. A rotating tool according to claim 1, wherein said cross-sectional profile has a sawtooth shape with an essentially radially extending breast portion with a radially outwardly oriented end forming said cutting edge, a sawtooth head extending essentially in a circumferential direction, and a sawtooth back portion forming said chip space.

5. A rotating tool according to claim 1, wherein a distance between adjacent ones of said micro cutting grooves is 35 to 600 μm and wherein a depth of said micro cutting grooves is 20 to 1,000 μm.

6. A rotating tool according to claim 1, wherein said thickness of said layer of extremely hard material is 1 to 5 μm.

7. A rotating tool according to claim 1, wherein said working surface further comprises transverse grooves that divide said micro cutting grooves, said transverse grooves extending at an angle relative to said micro cutting grooves.

8. A rotating tool according to claim 7, wherein said micro cutting grooves and said transverse grooves extend in an arcuate manner.

9. A rotating tool according to claim 7, wherein said transverse grooves extend in an arcuate manner.

10. A rotating tool according to claim 1, wherein said micro cutting grooves extend in an arcuate manner.

* * * * *